US008215339B2

(12) United States Patent
O'Leary

(10) Patent No.: US 8,215,339 B2
(45) Date of Patent: Jul. 10, 2012

(54) VAPOR BARRIER WITH VALVE FOR A BUILDING

(75) Inventor: Robert J. O'Leary, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 206 days.

(21) Appl. No.: 12/486,011

(22) Filed: Jun. 17, 2009

(65) Prior Publication Data

US 2010/0319275 A1 Dec. 23, 2010

(51) Int. Cl.
*F16K 15/16* (2006.01)
*E04B 1/74* (2006.01)

(52) U.S. Cl. ..... 137/855; 137/852; 137/360; 137/512; 137/550

(58) Field of Classification Search ..... 137/855, 137/852, 360, 357, 358, 512, 550, 544
See application file for complete search history.

(56) References Cited

U.S. PATENT DOCUMENTS

| | | | | |
|---|---|---|---|---|
| 2,788,552 | A | 4/1957 | Miles | |
| 3,815,629 | A * | 6/1974 | Oberholtzer | 137/527.8 |
| 3,937,258 | A * | 2/1976 | Loomba | 137/855 |
| 4,385,477 | A | 5/1983 | Walls et al. | |
| 4,712,347 | A | 12/1987 | Sperber | |
| 4,719,734 | A | 1/1988 | Fell et al. | |
| 4,724,651 | A | 2/1988 | Fligg | |
| 5,194,038 | A * | 3/1993 | Klomhaus et al. | 137/512.1 |
| 5,287,674 | A | 2/1994 | Sperber | |
| 5,365,716 | A | 11/1994 | Munson | |
| 5,697,198 | A | 12/1997 | Ponder et al. | |
| 5,819,496 | A | 10/1998 | Sperber | |
| 6,262,164 | B1 | 7/2001 | Church et al. | |
| 6,793,713 | B2 | 9/2004 | Kretsinger et al. | |
| 6,808,772 | B2 | 10/2004 | Kunzel et al. | |
| 6,827,105 | B1 * | 12/2004 | Marble et al. | 137/854 |
| 7,040,345 | B2 * | 5/2006 | Koeger et al. | 137/512.15 |
| 7,243,683 | B2 * | 7/2007 | Stotkiewitz et al. | 137/859 |
| 7,263,810 | B1 | 9/2007 | Trauba | |
| 7,487,624 | B2 | 2/2009 | Baba | |
| 7,556,559 | B2 * | 7/2009 | Rivera et al. | 137/855 |
| 2004/0103603 | A1 | 6/2004 | Kunzel et al. | |

FOREIGN PATENT DOCUMENTS

WO 9839525 A1 9/1998

* cited by examiner

*Primary Examiner* — Kevin Lee
(74) *Attorney, Agent, or Firm* — MacMillan, Sobanski & Todd, LLC

(57) ABSTRACT

A vapor barrier for sealing an interior of a building from an insulation cavity defined by framing members of the building includes a flexible and substantially impermeable sheet having apertures to allow air to exit the insulation cavity during filling of the insulation cavity with loose fill insulation. The vapor barrier also includes one-way valves mounted across the apertures. The valves are configured to allow air flow out of the insulation cavity and into the building interior through the apertures and to prevent air flow and moisture diffusion from the building interior into the insulation cavity.

15 Claims, 4 Drawing Sheets

VAPOR BARRIER WITH VALVE FOR A BUILDING

TECHNICAL FIELD

This invention relates generally to a method and apparatus for insulating buildings. More particularly, this invention pertains to a vapor barrier for insulating building walls, ceilings and floors.

BACKGROUND OF THE INVENTION

The exterior walls of a building can be insulated in order to reduce the heating and cooling demands resulting from variations between the exterior temperature from the desired interior temperature. A wide range of fibrous, solid and foam insulating materials can be used to achieve this insulation. Similarly, ceilings and floors can also be insulated.

An insulation cavity in a building wall can be defined between upper and lower plates and between adjacent wall studs. In a ceiling, an insulation cavity can be defined between two rafters, an eave strut, and a crest or peak strut. The structure of a floor can define an insulation cavity between floor joists. An insulation cavity can be filled with a variety of different kinds of insulation. In one method for insulating an insulation cavity, insulation particles or loose-fill insulation is mixed with adhesive and blown or sprayed into the insulation cavity.

It can be desirable to the fill insulation cavities with insulation prior to the enclosure of the insulation cavities so that walls or other coverings such as ceilings or flooring need not be punctured. A retaining material, such as for example netting can be placed over the insulation cavities prior to the blowing/spraying to retain the loose-fill insulation in the insulation cavity during filling. After the insulation cavities are filled, a vapor barrier can be placed over the netting and the remaining wall or other coverings can be installed over the netting and the vapor barrier.

It would be advantageous to provide a vapor barrier that is easier to use.

SUMMARY OF THE INVENTION

A vapor barrier is provided for sealing an interior of a building from an insulation cavity defined by structural members of the building. The vapor barrier includes a flexible and substantially impermeable sheet having apertures to allow air to exit the insulation cavity during filling of the insulation cavity with loose fill insulation. The vapor barrier also includes one-way valves mounted across the apertures. The valves are configured to allow air flow out of the insulation cavity and into the building interior through the apertures and to prevent air flow and moisture diffusion from the building interior into the insulation cavity.

According to the invention there is also provided a method for insulating a building. The method includes the step of applying a flexible and substantially impermeable sheet to an interior side of a building wall structure. The method also includes the step of directing loose fill insulation into an insulation cavity defined in part by the framing members and by the flexible and impermeable sheet after the applying step. The method also includes the step of allowing air to escape from the insulation cavity during the directing step though a one-way valve mounted to the flexible and impermeable sheet.

Various advantages of this invention will become apparent to those skilled in the art from the following detailed description of the preferred embodiment, when read in light of the accompanying drawings.

DETAILED DESCRIPTION OF EXEMPLARY EMBODIMENTS

Figure 1:
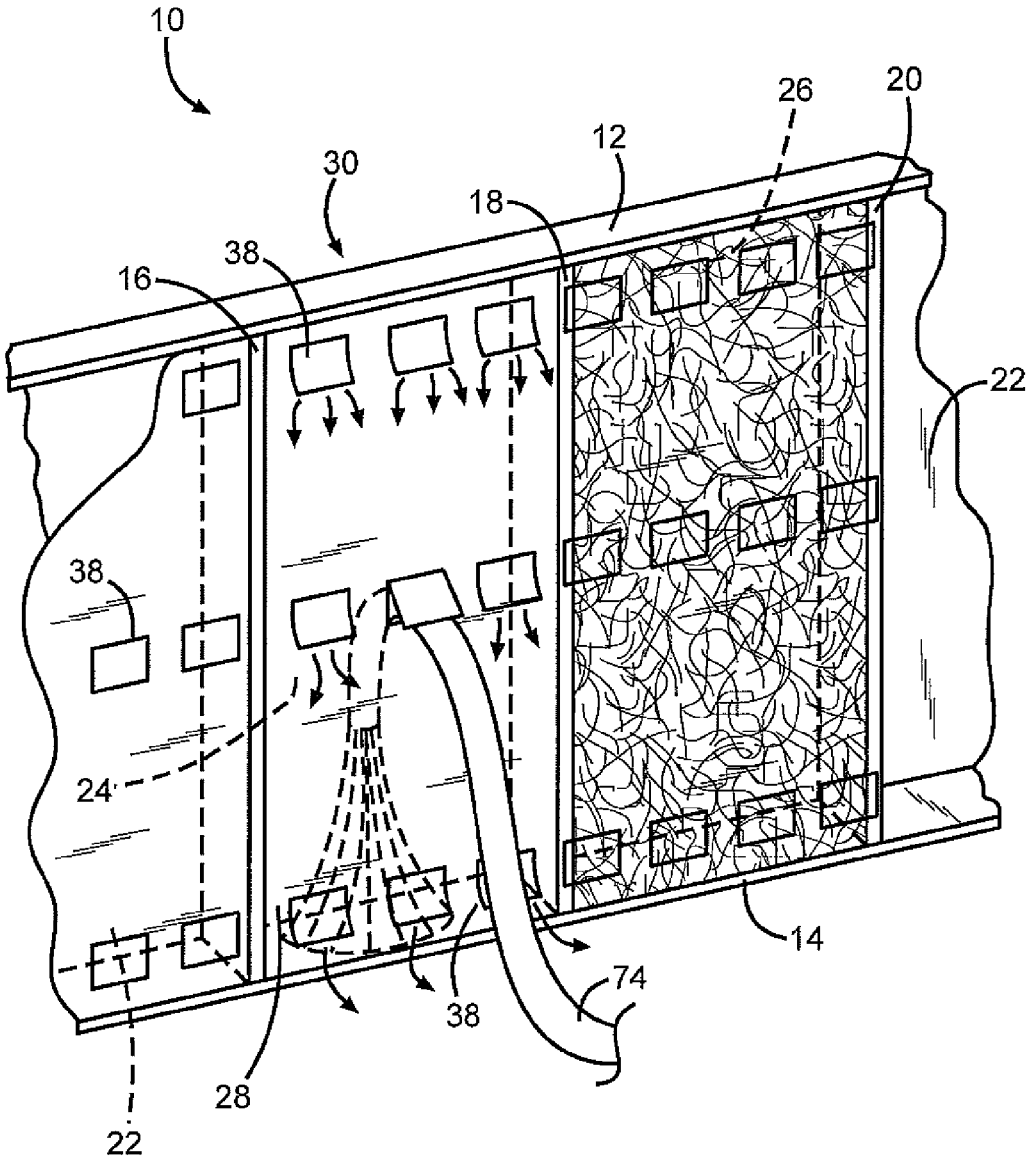
FIG. 1 is a partial perspective of a first embodiment of a vapor barrier mounted to a building wall.

Referring now to FIG. 1, a wall frame 10 of a building can include an upper plate 12, a lower plate 14, and wall studs 16, 18, 20. The perspective of FIG. 1 is from the inside of the building. A wall 22 closes an exterior side of the wall frame 10. The wall 22, the upper plate 12, the lower plate 14, and the wall studs 16, 18 define five sides of a six-sided insulation cavity 24. The wall 22, the upper plate 12, the lower plate 14, and the wall studs 18, 20 define five sides of a second six-sided insulation cavity 26. The sixth sides of the respective insulation cavities 24, 26 are defined by a sheet 28. The exemplary sheet can be clear, allowing the interior of the insulation cavities 24, 26 to be visible. The insulation cavity 26 is shown filled with loose-fill insulation and the insulation cavity 24 is shown with loose-fill insulation being introduced into the cavity 24. The sheet 28 can be connected to the wall frame 10 through staples, adhesive, clips, or other suitable mechanisms.

The sheet 28 is part of an exemplary vapor barrier 30 according to one embodiment. The exemplary vapor barrier 30 also includes valves 38 and filters 52, which will be described in greater detail below. The vapor barrier 30 is operable to seal an interior of a building from an insulation cavity defined by structural members of the building. In the illustrated embodiment, the sheet 28 of the vapor barrier 30 is substantially flexible and substantially impermeable to water vapor.

Figure 2:
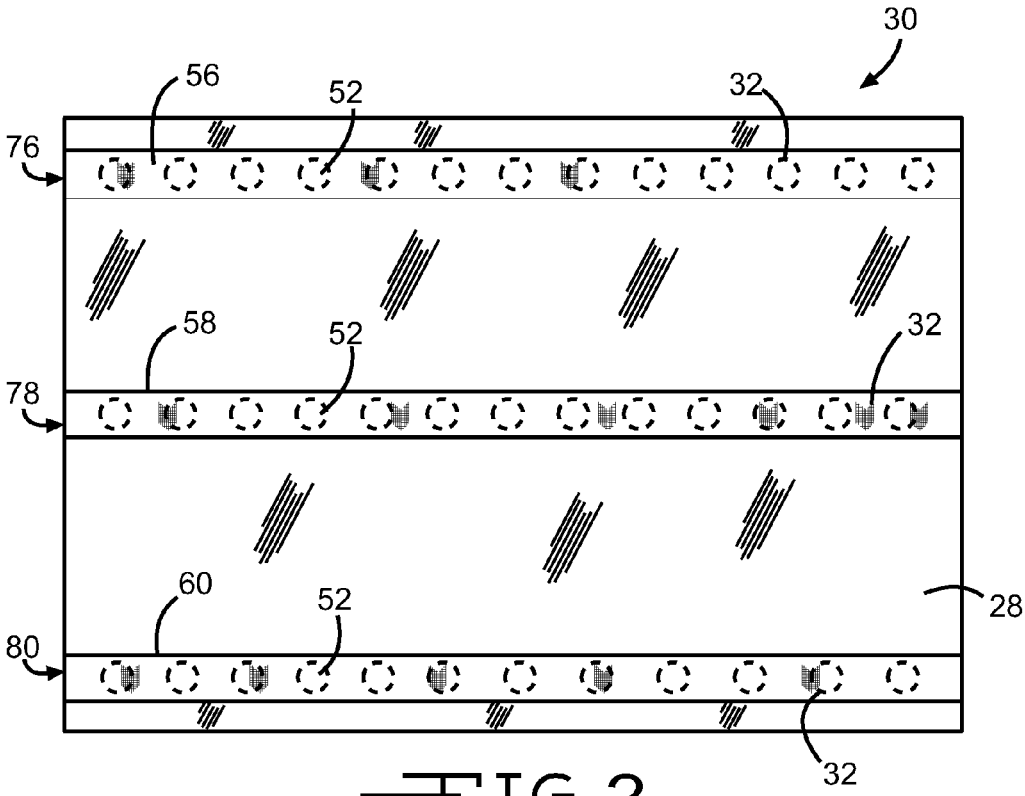
FIG. 2 is rear view of the first embodiment of the vapor barrier of FIG. 1, wherein the shown side of the first embodiment faces the insulating cavity.
Figure 3:
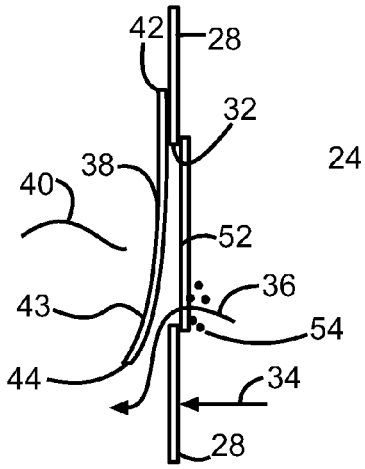
FIG. 3 is a section view of an exemplary one-way valve of the vapor barrier of FIG. 1.
Figure 4:
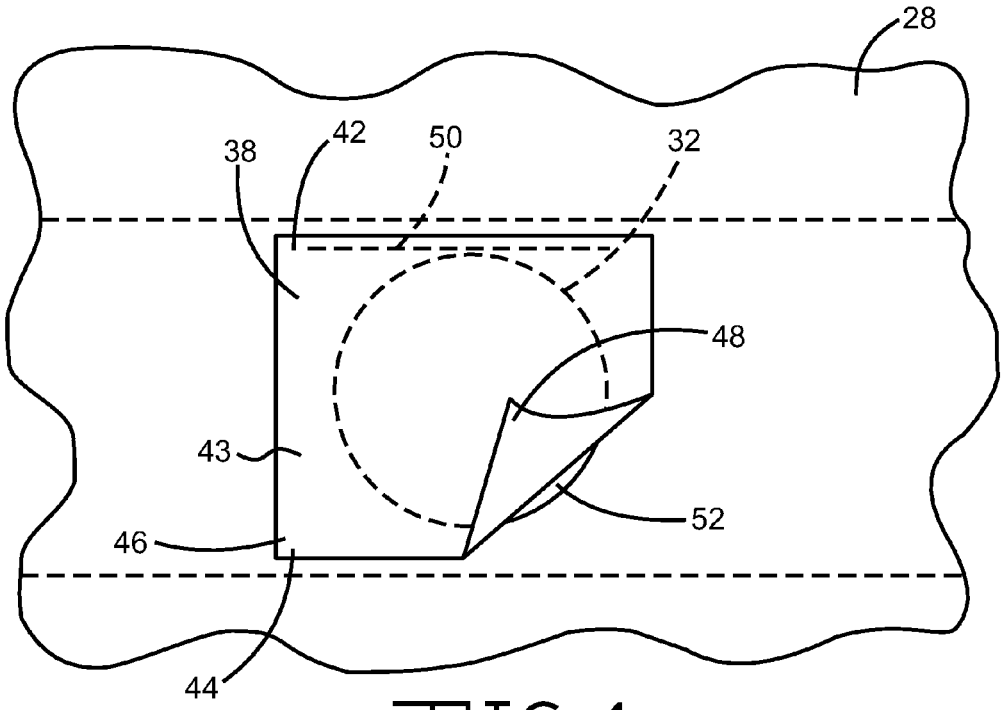
FIG. 4 is front view of the exemplary one-way valve of FIG. 3.

Referring now to FIGS. 2-4, the sheet 28 includes apertures 32 to allow a flow of air to exit the insulation cavities 24, 26 (shown only in FIG. 1) while the insulation cavities 24, 26 are filled with loose fill insulation. As best shown in FIG. 3, the air flow represented by arrows 34, 36 will be directed toward the sheet 28 during filling of the insulation cavity 24. The air flow represented by arrow 34 is blocked by the sheet 28. The air flow represented by arrow 36 can pass through the aperture 32 to evacuate the insulation cavity 24.

The vapor barrier 30 also includes one-way valves 38 mounted in the apertures 32. The valves 38 are configured to allow air flow out of the insulation cavity and into the interior through the apertures 32 and to prevent air flow from the interior into the insulation cavities. As best shown in FIG. 3, air flow represented by arrow 40 is blocked by the valve 38 from entering the insulation cavity 24.

As shown by the FIGS. 3-4, valves 38 can be flapper valves 38. Each flapper valve 38 includes a valve sheet 43. As clearly shown in FIGS. 3 and 4, the valve sheet 43 is flexible and valve sheet 43 is self-supporting, that is, the valve sheet 43 is not attached to or supported by any form of frame or framework. Each valve sheet 43 can extend between a base end 42 fixed to the sheet 28 and a distal end 44. The distal end 44 of the valve sheet 43 is moveable between a first position in contact with the sheet 28 (a closed position) and a second position spaced from the sheet 28 (an open position). FIG. 4 shows a first corner 46 of the distal end 44 in the first position and a second corner 48 of the distal end 44 in the second position. FIG. 3 shows the distal end 44 in the second position.

As shown in FIG. 4, the base end 42 can be fixed to the sheet 28 through a seam weld 50. The base end 42 can also be fixed to the sheet 28 through adhesive, clips, clamps, or other suitable mechanisms. The exemplary connection between the base end 42 and the sheet 28 is a discontinuous straight line, but the broader invention is not so limited. The base end 28 can be fixed to the sheet 28 along a continuous connection. Alternatively, the base end 28 can be fixed to the sheet 28 along an arcuate connection, such as a line of adhesive extending less than fully around the aperture 32. Alternatively, the base end 28 can be fixed to the sheet 28 through other suitable connections.

Optionally, the distal end 44 can be statically charged such that the distal end 44 and the sheet 28 are normally drawn together to seal the aperture 32. In operation, as the flow of air is evacuating the insulation cavity 24, the distal end 44 can be positioned as shown in FIG. 3. After the insulation cavity 24 is filled, the distal end 44 can be drawn back into contact with the sheet 28 substantially immediately after air pressure in the insulation cavity 24 has lowered to ambient pressure or less. The valve 38 can be configured so that gravity will close the valve 38 if charging the sheet 28 or the valve 38 is not used.

It is noted that flapper valves 38 can be desirable based on their simple design. The flapper valves 38 can also be desirable because they can be made flat and won't interfere with subsequently applied drywall. However, the broader invention is not limited to being practiced with flapper valves. Other concerns may exist in other operating environments in which other embodiments can be practiced having valves of different form and/or operation. Embodiments can be practiced with diaphragm check valves in which a diaphragm plastically deforms in response to a predetermined level of pressure to allow an air flow in one direction. The diaphragm check valve could then revert to a static shape and thus close when the pressure has subsided. Poppet or ball check valves can also be used if desirable. It is also noted that embodiments can be practiced in which different types of valves are applied in different apertures on a single sheet.

In another alternative embodiment the valve 38 and the sheet 28 can be formed from different materials. For example, the valve 38 can be formed from nylon and the sheet 28 can be formed from other desired vapor barrier materials, such as but not limited to aluminum foil, paper-backed aluminum, polyethylene, asphalt-coated kraft paper. The valves 38 can have a water vapor diffusion resistance that varies in relation to ambient humidity. For example, the valves 38 can be formed from the material disclosed in U.S. Pat. No. 6,808,772, which is hereby incorporated by reference. This material can allow an acceptable level of humidity transfer between the interior of the building and the insulation cavities while, at the same time, prevent undesirable air flow.

Generally, water vapor can move in and out of a building by diffusion and by air transport. The movement of water vapor by diffusion is dependent on the permeability of the structures defining the vapor barrier for the building. Permeability is rated in perms and is a measure of the rate of transfer of water vapor through the material. The equation for the permeability of a material of predetermined thickness is:

$$P=G/(A*T*P)$$

The component G represents the amount of water vapor in grains that pass through the material. One pound is equal to seven thousand grains. The component A represents the area in square feet over which the water vapor diffuses. The component T represents the time in hours over which diffusion occurs. The component G represents the pressure during diffusion in inches of mercury. The perm rating is identified in conjunction with the thickness of the material.

The exemplary vapor barrier 30 can be an air barrier that prevents the passage of water vapor by air transport. The exemplary vapor barrier 30 can also resist the diffusion of water vapor. The exemplary vapor barrier 30 can have a permeability rating of under 10 perms. The individual components of the exemplary vapor barrier 30 can define the same perm rating or can define different perm ratings. As set forth above, the valves 38 can be formed from a material having a water vapor diffusion resistance that varies in relation to ambient humidity. The sheet 28 can also be formed from a material having a water vapor diffusion resistance that varies in relation to ambient humidity.

The exemplary vapor barrier 30 optionally can also include filters 52 mounted on the sheet 28 and extending across the apertures 32. As best shown in FIG. 3, the filter 52 can prevent particles 54 of loose-fill insulation from escaping the insulation cavity 24 when the flow of air evacuates during filling. The filters 52 can be made from any desired material or combination of materials. The filters 52 can be made from paper and can be pleated or unpleated. The filters 52 can made from woven or clumped plastic fibers. The filters 52 can be made from foam, cotton, or any other suitable material for filtering the flow of air evacuating the insulation cavity 24.

In the exemplary embodiment, the filters 52 and the valves 38 can be mounted to the sheet 28 on opposite sides relative to one another. In other embodiments, the filters 52 and the one-way valves 38 can be mounted on the same side of the sheet 28. The filters 52 can be mounted to the sheet 28 using any suitable approach, including but not limited to sonic welding and adhesive.

The filters 52 can be integral with one another. As best shown in FIG. 2, exemplary filters 52 can be defined by one of three strips 56, 58, 60 of filter material. Forming the filters 52 from strips of filter material can be desirable in that strips of material can enhance the strength of the vapor barrier 30 in holding the loose-fill insulation in the insulation cavity 24.

It is noted that the apertures 32 can be formed in any shape and any number of apertures 32 can be formed in the sheet 28. The apertures 32 can be arranged in any pattern or can be arranged in a random arrangement. The exemplary apertures 32 are arranged in top, middle and bottom rows 76, 78, 80 (referenced in FIG. 2). It is noted that the alternative embodiments can be practiced without the apertures 32 arranged in rows or with apertures 32 arranged in a different number of rows.

In operation, a nozzle or hose 74 (shown in FIG. 1) for injecting loose fill insulation can be inserted in an aperture 32 (shown in FIG. 2) of the middle row 78 (shown in FIG. 2) of apertures 32 and pierce the middle strip 58 (shown in FIG. 2) of filter material. As loose-fill insulation is received in the insulation cavity 24, air can evacuate through the top row 76 (shown in FIG. 2) of apertures 32, the bottom row 80 (shown in FIG. 2) of apertures 32, and the apertures 32 of the middle row 78 (shown in FIG. 2) that communicate with the insulation cavity 24 (except the aperture 32 through which the nozzle extends). Thus, the insulation cavity 24 can be enclosed with a single flexible structure operable to both retain the loose fill insulation and define an impermeable vapor barrier.

Figure 5:
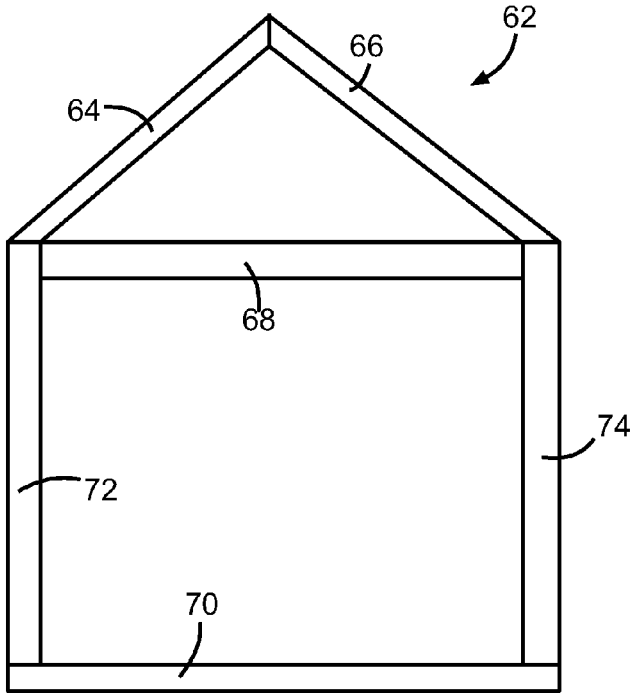
FIG. 5 is a simplified schematic of a building showing locations for applying various embodiments of the broader invention.

FIG. 5 is a simplified schematic of a building 62. Insulation cavities 64, 66, 68, 70, 72, 74 can be defined in the roof, the ceiling, the floor, and the walls, respectively. Embodiments of the invention, disclosed above or subsequently developed, can be applied to any of the insulation cavities 64, 66, 68, 70, 72, 74.

Figure 6:
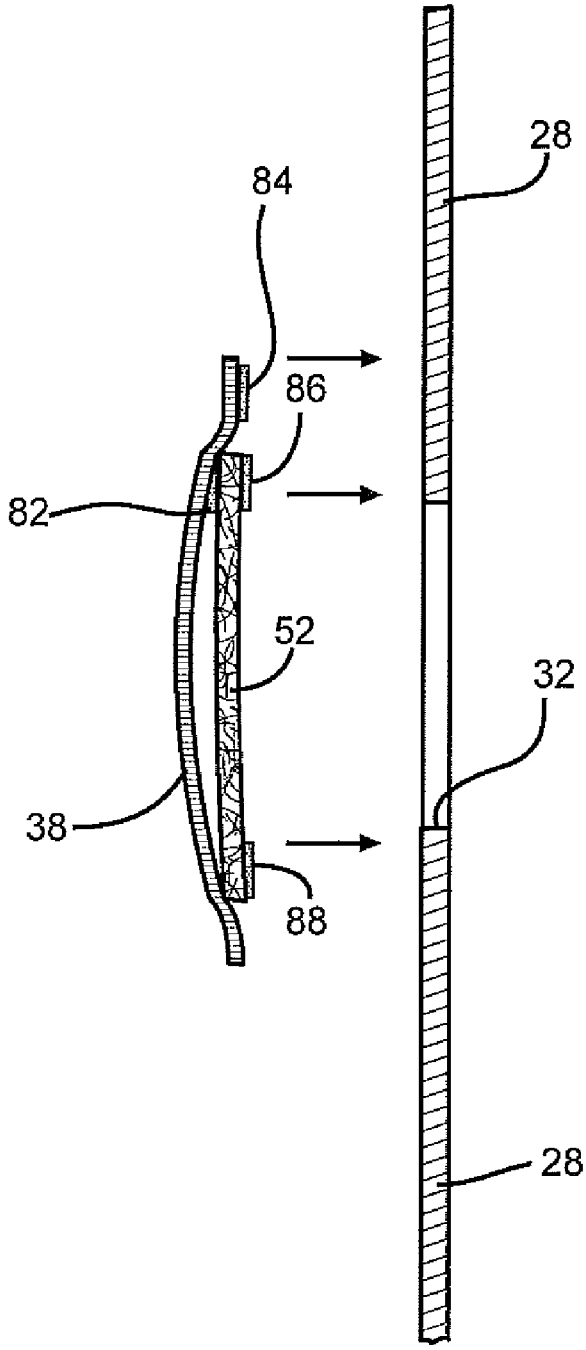
FIG. 6 is a section view of a second exemplary one-way valve of the vapor barrier of FIG. 1.

FIG. 6 shows an alternative embodiment of the invention. The exemplary vapor barrier 30 in FIG. 6 includes a sheet 28, a valve 38 and a filter 52. The valve 38 and the filter 52 can be coupled together prior to being mounted across an aperture 32 on the sheet 28. During assembly, the valve 38 and the filter 52 can be connected together through a quantity of adhesive 82. Methods other than the application of adhesive can be applied to connect the filter 52 and the valve 38. The coupled valve 38 and filter 52 can then be mounted to the same side of the sheet. The valve 38 can be connected to the sheet 28 through a quantity of adhesive 84. Methods other than the application of adhesive can be applied to connect the sheet 28 and the valve 38. The filter 52 can be connected to the sheet 28 through first and second quantities of adhesive 86, 88. Methods other than the application of adhesive can be applied to connect the sheet 28 and the filter 52. The filter 52 can be connected to the sheet 28 such that the connection is continuous about a perimeter of the aperture 32 so that all of the air passing out of the aperture is directed through the filter 52. The perimeter of the valve 38 can surround the perimeter of the filter 52 so that the valve 38 fully covers the filter when in the valve 38 is in the closed position.

The principle and mode of operation of the invention have been described in its preferred embodiments. However, it should be noted that the invention may be practiced otherwise than as specifically illustrated and described without departing from its scope.

What is claimed is:

1. A vapor barrier for sealing an interior of a building from an insulation cavity defined by structural members of the building, the vapor barrier comprising:

a flexible and substantially impermeable sheet having apertures to allow air to exit the insulation cavity during filling of the insulation cavity with loose fill insulation; and one-way valves mounted across the apertures, the valves configured to allow air flow out of the insulation cavity and into the building interior through the apertures and to substantially prevent air flow from the building interior into the insulation cavity, wherein the flapper valves have the structure of flexible and frameless valve sheets configured to extend from a respective base end fixed to the impermeable sheet to a respective distal end, wherein the valve sheets are movable between a first position and a second position, wherein in a first position, the base ends and the distal ends of the valve sheets overlap portions of the impermeable sheet and are in contact with the impermeable sheet, and in a second position, the distal ends of the valve sheets are spaced from the impermeable sheet.

2. The vapor barrier of claim 1 in which the one-way valves are flapper valves.

3. The vapor barrier of claim 1 in which the distal end is statically charged such that the distal end and the sheet are drawn together to seal the aperture.

4. The vapor barrier of claim 2 in which the flapper valves and the sheet are formed from different materials.

5. The vapor barrier of claim 4 in which the flapper valves are formed from nylon.

6. The vapor barrier of claim 1 in which the valves have a water vapor diffusion resistance that varies in relation to ambient humidity.

7. The vapor barrier of claim 1 in which the sheet has a water vapor diffusion resistance that varies in relation to ambient humidity.

8. The vapor barrier of claim 1 further comprising:

filters mounted on the sheet and extending across the apertures.

9. The vapor barrier of claim 8 in which the filters and the one-way valves are mounted to the sheet on opposite sides relative to one another.

10. The vapor barrier of claim 8 in which the filters and the one-way valves are mounted to the same side of the sheet.

11. The vapor barrier of claim 8 in which the filters are integral with one another.

12. The vapor barrier of claim 11 in which the apertures are arranged in a row and the filters are defined by a single strip or a plurality of strips extending a length of the row.

13. The vapor barrier of claim 10 in which the filters and the one-way valves are connected together.

14. The vapor barrier of claim 1 in which the apertures are configured to allow insertion of a nozzle for injecting loose fill insulation into the insulation cavity.

15. A vapor barrier for sealing an interior of a building from an insulation cavity defined by structural members of the building, the vapor barrier comprising:

a flexible and substantially impermeable sheet having apertures to allow air to exit the insulation cavity during filling of the insulation cavity with loose fill insulation; and one-way valves mounted across the apertures, the valves configured to allow air flow out of the insulation cavity and into the building interior through the apertures and to substantially prevent air flow from the building interior into the insulation cavity, wherein the one-way valves are movable between a first position and a second position, wherein in a first position, the base ends and the distal ends of the one-way valves overlap portions of the impermeable sheet and are in contact with the impermeable sheet, and in a second position, the distal ends of the one-way valves are moveable between a first position in contact with the impermeable sheet and a second position spaced from the impermeable sheet; and wherein in the second position, the one-way valves are configured to lay flat against the sheet such as not to interfere with subsequently applied drywall.

* * * * *